US006209785B1

(12) United States Patent
Ben-Haim

(10) Patent No.: US 6,209,785 B1
(45) Date of Patent: Apr. 3, 2001

(54) BOXES

(75) Inventor: Amit Ben-Haim, London (GB)

(73) Assignee: Allied Balfour Limited, St. Helier (GB)

( * ) Notice: Subject to any disclaimer, the term of this patent is extended or adjusted under 35 U.S.C. 154(b) by 0 days.

(21) Appl. No.: 09/124,420

(22) Filed: Jul. 29, 1998

(30) Foreign Application Priority Data

Feb. 3, 1998 (GB) ..... 9802178

(51) Int. Cl.[7] ..... B65D 17/00

(52) U.S. Cl. ..... 229/223; 229/120.21; 229/224; 229/234; 206/542

(58) Field of Search ..... 229/223, 200, 229/210, 401, 224, 120.21, 234; 206/223, 541, 542

(56) References Cited

U.S. PATENT DOCUMENTS

| | | | | |
|---|---|---|---|---|
| 1,921,150 | * | 8/1933 | Bomberger | 229/132 |
| 1,963,299 | * | 6/1934 | Fear | 229/120.13 |
| 2,142,131 | * | 1/1939 | Inman | 229/542 X |
| 3,638,853 | * | 2/1972 | Perry | 229/223 |
| 3,708,104 | * | 1/1973 | Buttery | 229/208 |
| 3,946,937 | * | 3/1976 | Forbes, Jr. et al. | 229/222 |
| 4,088,263 | * | 5/1978 | Michetti | 229/120.13 |
| 4,872,555 | * | 10/1989 | Shadrach, III et al. | 206/831 |
| 5,118,034 | * | 6/1992 | Tsao | 206/542 X |

FOREIGN PATENT DOCUMENTS

| | | | | |
|---|---|---|---|---|
| 1229030 | * | 9/1960 | (FR) | 229/223 |
| 1427361 | * | 12/1965 | (FR) | 229/222 |
| 1428558 | * | 1/1966 | (FR) | 229/222 |
| 0449968 | * | 12/1965 | (GB) | 229/223 |

* cited by examiner

*Primary Examiner*—Allan N. Shoap
*Assistant Examiner*—Tri M. Mai
(74) *Attorney, Agent, or Firm*—Levisohn, Lerner, Berger & Langsam

(57) ABSTRACT

A box (200) for solid and semi-solid food products is formed from a blank and has a body portion, a base portion and a lid portion, the lid portion having a tear-away strip for opening the sealed box. Side panels (22) of the body portion have overlapping end flaps (34, 38) which lie across the top of the body portion and have crease lines (46) running substantially parallel to the fold line which separates the flaps from their respective panels. The creased regions are pushed inwards towards their respective panels and the non-creased region of each flap lies substantially perpendicular to the side panels to form a suspended surface. This surface may support a spoon (S) or other item and is covered by the overlapping end flaps (54, 56) on the front and rear panels of the body portion; thereby allowing the item to be sold with the food product as a single unit but without contacting the food product.

16 Claims, 5 Drawing Sheets

BOXES

DESCRIPTION

The present invention relates to improvements in boxes, especially boxes suitable for solid or semi-solid materials, such as frozen desserts, frozen cakes and ice cream.

Folding boxes are well known in the packaging art. The boxes are constructed from flat blanks, being pre-cut and pre-scored cardboard sheets which are folded into the required shape and secured by means of known adhesives. The boxes are used for packaging retail products, particularly consumable goods. During the filling operation, packaging machinery is used to form the box from the blank, fill it with product and then seal the fully assembled boxes according to a prescribed folding sequence and adhesive pattern.

Frozen, consumable products are most frequently supplied in cartons made of a plastics or cardboard material comprising a container portion and a lid. A spoon for eating the product is then supplied separately with the product. Such cartons are environmentally unfriendly, are not tamper proof and are not convenient. The round-shaped tubs in which frozen desserts and the like are most usually supplied to the consumer are not ideal since the tubs cannot be shrink-wrapped and cannot be sold in rectangular multi-packs.

Further state of the art boxes include those formed as a single unit from blanks which are suitable for such food products as ice cream and frozen yoghurt. However, such boxes have a number of drawbacks including leakage of the contents from the box and being difficult to open and eat from. Additionally, a large number of flaps are used to assemble and secure the box in its constructed state which are visible from the outside thus reducing the neat appearance of the box which results in the box being less consumer-appealing.

It is an object of the present invention to provide an improved box, particularly for solid and semi-solid products, in which leakage of the contents of the box may be avoided. A further object of the present invention is to provide a box which is tamper evident and is easy to eat from.

Another object of the present invention is to provide a box which is more visually appealing to the consumer. Yet a further object of the present invention is to provide a box which is easily opened by the user to provide access to the product. Still a further object of the present invention is to provide a box in which means for consuming the contents thereof is conveniently provided therein.

Another object of the present invention is to provide a rectangular box which may be conveniently shrink-wrapped and is suitable for supplying to the consumer in multi-pack portions to result in a much higher and efficient usage of pallets for improved distribution and display of the boxes.

Accordingly, the present invention provides a box, suitable for a solid or semi-solid food product, made up from a blank to form a three dimensional rectangular section box comprising:

a body portion having a side panel, a rear panel, a second side panel and a front panel;

a base portion formed from the folding inwards of end flaps provided on said side panel, rear panel, second side panel and front panel and secured together by means of an adhesive;

a lid portion having two overlapping flaps and a third top flap secured to the body portion by means of an adhesive, the top flap being provided with a tear-away zip for opening the box.

It is preferable that the flaps of the box are secured by means of a hot, melt adhesive.

Preferably, the front panel of the body portion is provided with an end flap for securing to the side panel separate to the front panel, during assembly of the box. A strip of adhesive is preferably provided along the intended innermost surface of the flap for securement to the side panel.

It is to be appreciated that the side panels of the body portion are of substantially the same dimension, as are the rear and front panels, such as to form a three dimensional rectangular box in the assembled state.

Preferably, the end flaps of the said side panels for forming the base portion are dimensioned such that, in the assembled box, the flaps overlap one another. Preferably, the end flap of the rear panel is folded inwards first and the end flaps of the side panels are folded thereover. The end flap of the front panel is then folded over these flaps and adhered thereto. It is preferable that at least one of the end flaps of the side panels is provided with an indented side to prevent the flap being visible in the fully assembled box. Adhesive may also be provided between the innermost end flap and the end flaps of the side panels.

An additional flange may be provided running along the length, or a part thereof, of the end flap of the rear panel between the end flaps of the side panel. Preferably, the connection between the flange and the end flap is half cut to allow the flange to be bent at approximately 90° and tucked in against the front panel in the assembled box.

It is preferable that the two overlapping flaps of the lid portion are continuous with the side panels of the body portion, being separated therefrom by fold lines. Preferably, one flap is greater in length than the other such that, in the assembled box, the longer flap overlaps the shorter flap, or vice versa. In this manner, means for consuming or removing the contents of the box such as a spoon or other item may be placed on the surface created by the overlapping flaps.

More preferably, the two overlapping flaps of the lid portion are each provided with a series of substantially parallel crease lines running near to and parallel with the fold line separating the flaps from their respective side panels. Preferably, the creases are provided across approximately one third of the length of the flap. In constructing the assembled box, the creased regions of the flaps are pushed inwards towards their respective side panel with the non-creased region of each flap lying substantially perpendicularly to the side panels thereby forming a suspended surface across the opening of the box which may have an item, such as a spoon, placed thereon. The top flap is then folded over and secured to a part of the box. In this manner, the item is separated from contacting the food product contained in the box and lies below the top flap of the front panel.

Preferably, the top flap comprises two sections, a first section for folding over the overlapping end flaps of the side panels and a second section for folding over the front panel and securing the lid to the body portion by means of adhesive. Preferably, the second section is provided with the tear-away zip for detaching the lid portion from the body portion to enable opening of the box. Preferably, the top flap is continuous with the rear panel of the body portion.

Alternatively, the top flap comprises two sections, one section being continuous with the rear panel of the body portion and the second section being continuous with the front panel of the body portion, both sections being separated from their respective panels by fold lines. The sections are at least half the width of their respective panels, preferably being approximately two-thirds the width thereof.

Each portion is provided with a line of complimentary spaced apart cut lines to form respectively male and female portions of a tear-away zip. In assembling the box, the sections are folded over the overlapping end flaps of the side panels and secured to each other by means of adhesive. Preferably, a line of adhesive is provided between the outermost edge of one of the sections and the cut line thereof for securement to the corresponding part of the underlying section. In this manner, the complimentary spaced apart cut lines of the sections form a tear-away strip in the assembled box which, upon removal, results in the simultaneous removal of the adhesive which secures the two flaps. This is advantageous for safety reasons in that adhesive is not left on the box which may be accidently ingested, particularly by a child.

Preferably, cut lines into but not through the cardboard are provided above and below the tear-away strip to prevent pulling away of the cardboard above or below the strip when it is removed. Preferably, a tab is provided at one end of the strip to assist in the removal thereof.

In either case, the sealed end flap of the top panel provides a barrier between the contents of the box and the external surroundings which is required for hygienic purposes. The tear-away zip also provides evidence that the box has been tampered with.

Each of the two overlapping flaps of the lid portion may also be provided with a line of weakness, for example a line of perforations or half-cut lines, near to or at the fold line with their respective side panel. This allows convenient removal of the flaps upon opening the box to enable easier access to the contents thereof.

The assembled boxes may be shrink wrapped, may be produced in a variety of sizes and may be conveniently supplied in multi-packs. It is clear that any suitable means for assisting in the removal of the contents from the box, such as a spoon or fork may be inserted into the box before closing. The means may be made of a plastics material or, for example, wood and may be wrapped in a suitable casing.

For a better understanding of the present invention and to show more clearly how it may be carried into effect reference will now be made, by way of example only, to the accompanying drawings in which.

Figure 8:
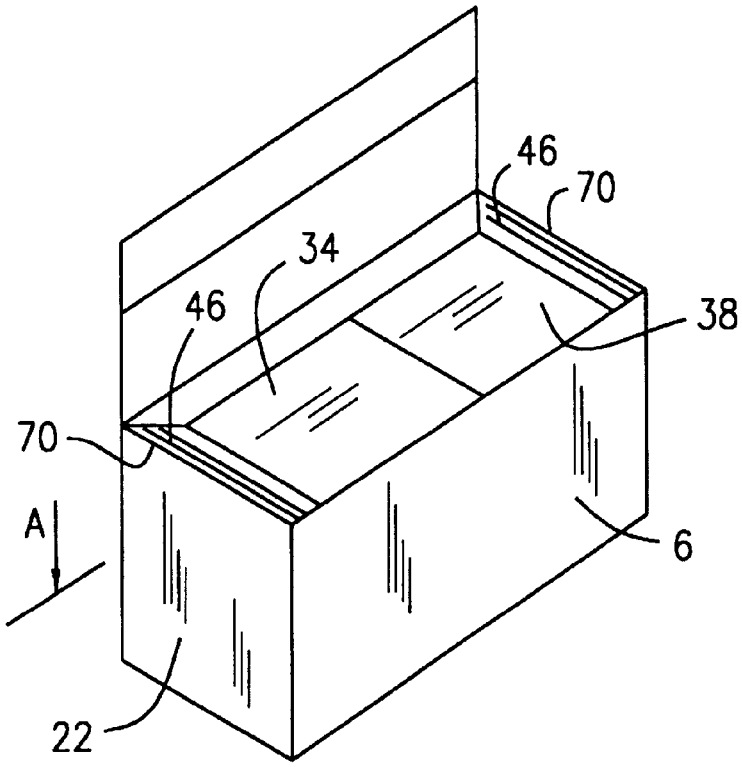
Figure 9:
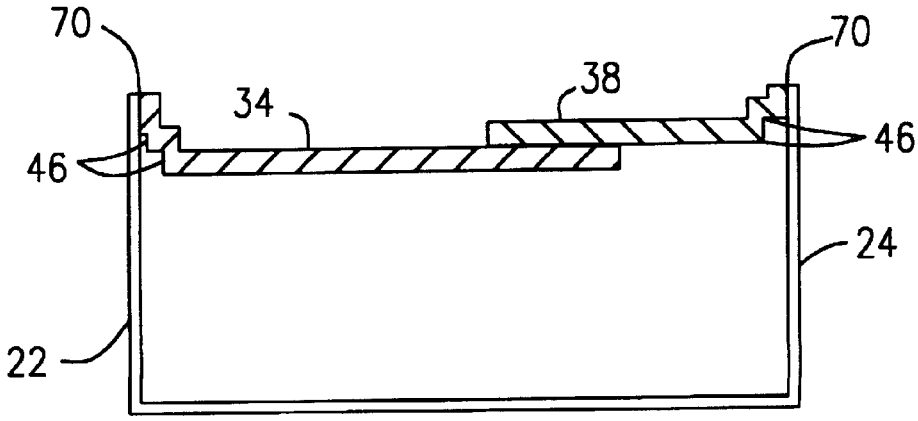

FIG. 8 is a perspective view of the opened box in accordance with the present invention showing a suspended surface, parallel to the bottom of the box formed by overlapping the two flaps; and FIG. 9 is a cross sectional view of the box shown in FIG. 8 taken along line A—A and yet showing an exaggerated gapping between the sides of the box and the overlapping flaps, for case of illustration and understanding.

Figure 1:
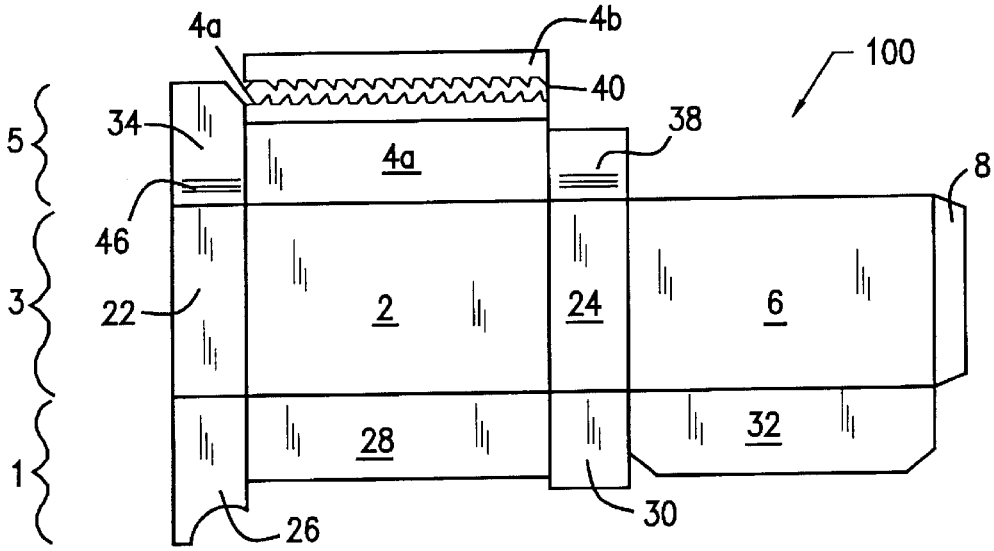
FIG. 1 shows a blank for a box according to one preferred embodiment of the present invention.
Figure 2:
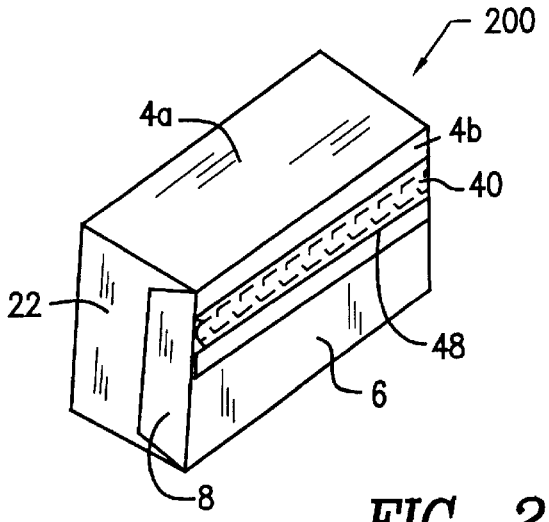
FIG. 2 is a perspective view of a sealed box made from the blank of FIG. 1.
Figure 3:
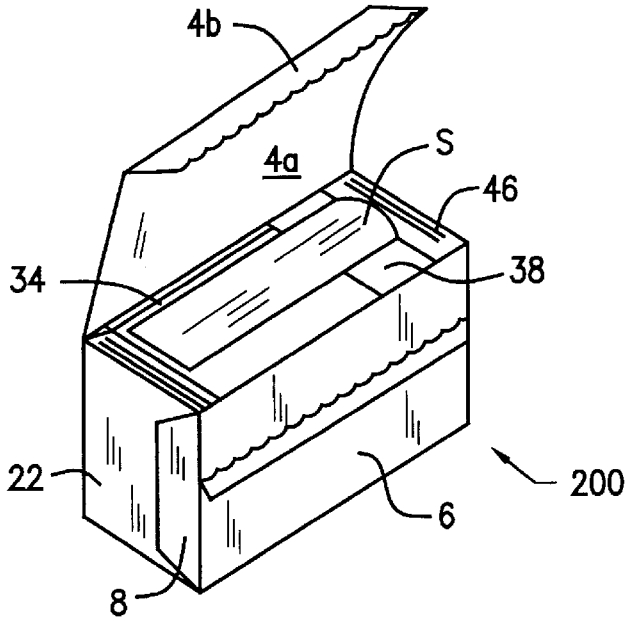
FIG. 3 is a perspective view of the opened box shown in FIG. 2.

Referring to FIGS. 1 to 3 of the accompanying drawings, one embodiment of a box according to the present invention is illustrated. A box 200 is constructed from a blank 100, as shown in FIG. 1. The blank 100 is cut and folded from cardboard having its intended inner surface coated with polyethylene, wax or any other known barrier depending upon the foodstuff to be contained in the box thereby preventing seepage of the contents of the box through the cardboard.

The blank has a base-forming section 1, a body-forming section 3 and a lid-forming section 5. The body-forming section 3 comprises, in the given order and separated by fold lines, a side panel 22, a rear panel 2, a second side panel 24, and a front panel 6 provided with an end flap 8. Each of the respective panels 22, 2, 24 and 6 have flaps 26, 28, 30 and 32 which comprise the base-forming section 1. Each of the panels 22, 2 and 24 are also provided respectively with further flaps 34, 4*ab* and 38 opposite the flaps of the base-forming section 1 which comprise the lid-forming section 5. Top flap 4*a* is continuous with the rear panel 2 of the base forming section, being separated therefrom by fold lines, and has a second section 4*b* continuous therewith but separated by fold lines which is provided with a tear-away strip 40 of the known zip type. Above and below the zip 40 are cut lines (not visible in FIG. 1) into but not through the cardboard material. These lines prevent the pulling away of the cardboard above or below the strip when it is torn off. One end of the strip 40 is provided with a tab 41 to enable easy removal thereof.

In assembling the box 200 from the blank 100, the side panels 22 and 24 are folded to lie substantially perpendicular to the rear panel 2. The front panel 6 is then folded across to meet the side panel 22 and the end flap 8 is folded over the side panel 22 and secured thereto by means of adhesive, thereby forming the body portion 3 of the box. The end flaps 30 and 26 of the side panels 24 and 22 are then folded inwards, in said order, such that the ends thereof at least meet or, preferably, overlap. The end flap 28 of the rear panel is then folded over these flaps and the remaining end flap 32 is folded over and adhered to flap 28 to form the base section 1 of the box.

Flaps 38 and 34 of the side panels 24 and 22 respectively are then folded over such that flap 34 overlies flap 38. The flaps 38 and 34 each have a series of parallel crease lines 46 across approximately a third of the length of each flap, running parallel to the fold line which separate the flaps from their respective side panels 24 and 22. In assembling the box, the crease regions 46 of the flaps are pushed inwards towards their respective side panel with the non-creased portion of each flap 38 and 34 lying substantially perpendicularly to the side panels to form a suspended surface across the opening of the box, as shown in FIGS. 8 and 9. A spoon or other item may then be placed on top of the suspended surface before folding the top flap 4*a* over the flaps 38 and 34 and securing the second section 4*b* to the front panel 6 by means of a strip of adhesive to complete construction of a closed, assembled box, as shown in FIG. 2. This allows the spoon or other item to be contained within the sealed box but is prevented from contacting either the foodstuff or the end flap of the front panel. Additionally, the top flap of the front panel provides a satisfactory barrier between the contents of the box and its surroundings which is advantageous for hygienic purposes. The top flap is also tamper proof.

Referring to FIG. 3 of the accompanying drawings, the assembled box, 200 may be easily opened to remove the spoon S and expose the contents thereof by removing the tear-away strip 40, lifting up the flap 4*a*, 4*b* and folding the flaps 34 and 38 outwards. The flaps 34 and 38 may also be provided with a line of perforations or half-cut lines (not shown) near to or at the fold line with their respective side panel to allow the convenient removal of the flaps to provide easier access to the contents of the box.

Figure 4:
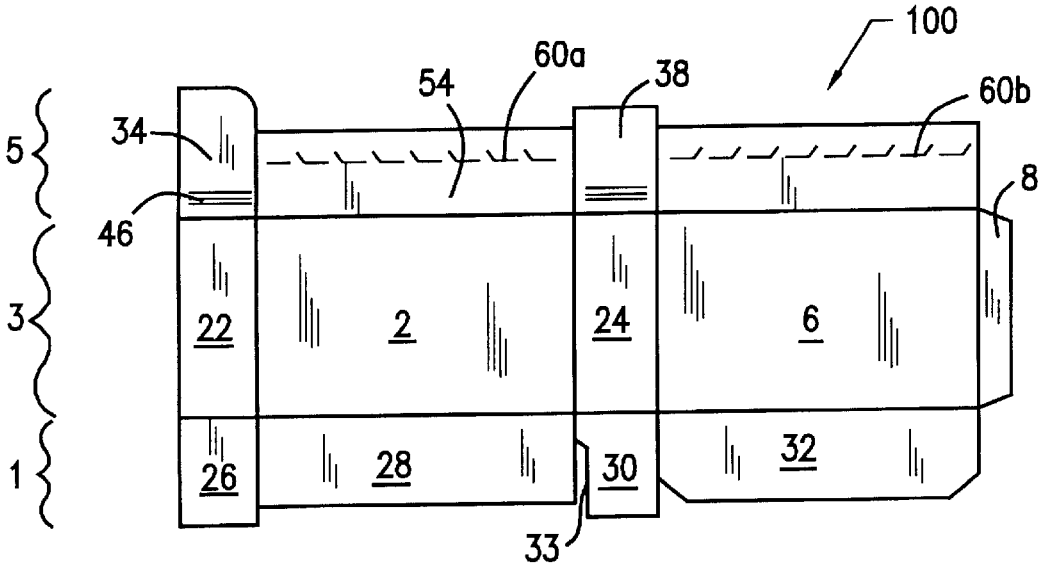
FIG. 4 shows a blank for a box according to another preferred embodiment of the present invention.
Figure 5:
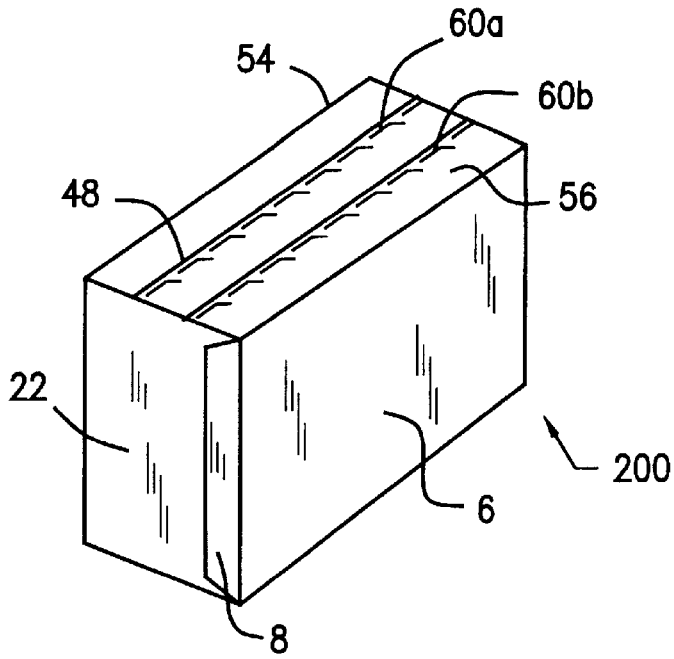
FIG. 5 is a perspective view of a sealed box made from the blank of FIG. 4.
Figure 6:
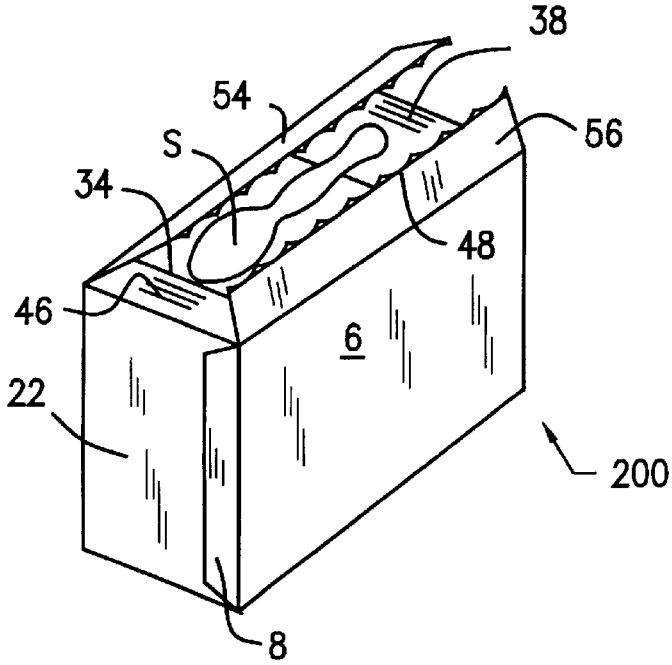
FIG. 6 is a perspective view of the opened box shown in FIG. 5.

FIGS. 4 to 6 of the accompanying drawings illustrate a second preferred embodiment of a box according to the present invention. For the sake of good order and simplicity, the identical features already described in relation to FIGS. 1 to 3 are given the same reference number and only the differences will be described in detail. The rear panel 2 of the base-forming section 3 is provided with a flap 54 in the place of the two-part flap 4*ab* of the first embodiment, which is approximately two-thirds the width of the rear panel. The flap 54 has a line of spaced apart cuts 60*a* formed therethrough which create a female portion of a tear-away zip. Below the zip cuts 60*a* is a continuous cut line 48 into but not through the cardboard material (not visible in FIG. 4). Additionally, the front panel 6 has a second flap 56 opposite the flap which forms part of the base-forming section 1. The flap 56 is of similar dimensions to the flap 54 of the rear panel and is provided with a line of spaced apart cuts 60*b* to create a male portion of a tear-away zip, having a continuous cut line 48 immediately below the cuts 60*b*.

In assembling the carton, the base and body portions 1, 3 are constructed according to the instructions already described in relation to FIGS. 1 to 3 except that the end flaps 26 and 30 of the side panels 22 and 30 respectively are folded over the end flap 28 of the rear panel. The end flap 32 of the front panel 6 is then secured to the end flaps of the side panels. The end flap 30 is provided with an indented side 33 to prevent the flap being visible in the fully assembled box.

The lid portion 5 is formed by folding inwards flaps 38 and 34 such that flap 38 lies beneath flap 34. Again, crease lines 46 are provided in the two flaps to allow the construction of a suspended surface. A spoon S or such like may then be inserted to lie on the surface formed by the flaps. Flap 56 is then folded over flaps 38, 34 and the flap 54 is folded over and adhered to flap 56 by providing a strip of adhesive between the top edge of flap 54 and the cut lines 60*a*, to form the closed box 200 as shown in FIG. 5.

Referring to FIG. 6 of the accompanying drawing, the sealed box may be easily opened to remove the spoon S and expose the contents thereof by tearing away the zip formed by the complimentary female and male portions 60*a* and 60*b* and lifting up flaps 54 and 56.

Figure 7:
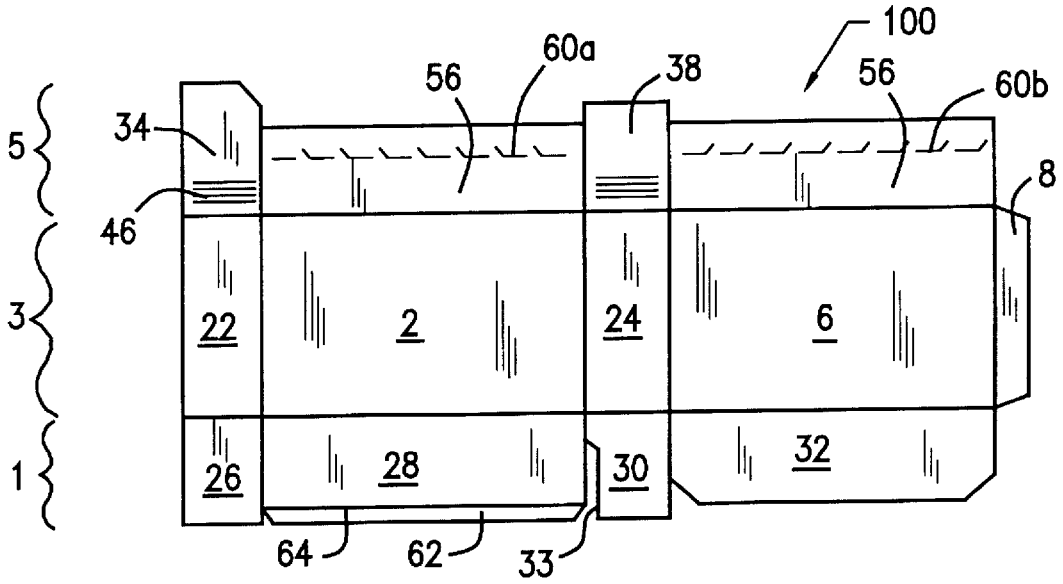
FIG. 7 is a blank for a box according to a further embodiment of the present invention.

A further blank for forming a box according to the present invention is shown in FIG. 7. The blank is provided with an additional flange 62 running along the length of the end flap of the rear panel 28 between the end flaps of the side panels, 26, 30. The fold line 64 between the flange and the end flap of the rear panel is half cut to allow the packing machine to bend the flange at 90° relative to the end flap and tuck the flange in against the front panel 6.

The boxes of the present invention are assembled by a specially constructed packing system which is able to erect, glue, fill and seal the boxes from their respective blanks. A blank is fully opened and placed on a conveyor belt which transports the blank to a bottom folding and gluing station. The opened box is then transported to a filling station where a nozzle enters the stationary box and delivers the consumable material thereto. Once the nozzle reaches the top of the box, the full box accelerates forward to a top folding and gluing section to seal the contents therein. A further station may be provided between the top folding and top gluing station to place a spoon on the flaps 34, 38 before adhering the final lid flaps to the main box.

The boxes of the present invention offer a number of advantages over those of the prior art. The construction of the folding of the two inner flaps of the box virtually eliminates any leakage of the contents from the sealed box thereby rendering the boxes more suitable for semi-solid products, such as ice cream and frozen yoghurt. These flaps also provide a suspended ledge for holding a spoon which is sealed within the box thereby enabling the spoon to be supplied as part as the complete box whilst being kept from contacting the food product contained therein. The incorporation of a tear-away zip also renders the box tamper-evident. This is particularly the case with the second preferred embodiment which, having the zip situated on the top end of the carton provides evidence from all views that the box has been tampered with.

The provision of the tear-away zip, either along the top or front of the box allows quick and easy opening thereof. The positioning of the adhesive between the cut-lines of the zip also results in the removal of all adhesive on the lid portion of the box when the box is opened. This is advantageous since adhesives, particularly hot melt adhesives contain solvent which can evaporate to result in the crystallisation thereof. This may be ingested by, for example a child and hence, the complete removal of the adhesive from around the opening of the box is desirable. The box is environmentally friendly, biodegradable and recyclable which are important qualities in today's environmentally conscious world. The particular construction of the box provides a simplified folding sequence having a reduced number flaps visible from the outside thus making the box more visually appealing. This also enables printing to be applied to all of the sides of the box, for example with regard to the product contained therein.

The provision of an in-line packing system to assemble, fill and seal the boxes of the present invention allows for an increased output of filled boxes leading to higher levels of efficiency and profitability. The system packing is also hygienic due to total mechanical handling of the product and box.

What is claimed:

1. A box suitable for a solid or semi-solid food product, made up from a cardstock blank to form a three dimensional rectangular section box comprising:

a body portion having a first side panel, a rear panel, a second side panel and a front panel;

a base portion formed from end flaps folded inwardly, one of said end flaps provided on each of said first side panel, rear panel, second side panel and front panel and secured by adhesive; and a lid portion comprises of two overlapping flaps, a first of said two overlapping flaps extending from said first side panel and a second of said two overlapping flaps extending from said second side panel, said overlapping flaps connected to said side panel by fold lines, the overlapping flaps, when folded inwardly and toward one another, extending substantially fully across the length of said front panel and said rear panel, and a top flap extending from either said front panel or said rear panel and being securable to said rear panel or front panel of said body portion, said top flap being provided with a tear-away opening strip for providing access to the box, wherein each of said two overlapping flaps of said lid portion further comprise a creased portion having a plurality of parallel and spaced crease lines, said two overlapping flaps and said plurality of parallel and spaced crease lines, said two overlapping flaps and said plurality of parallel and spaced crease lines being configured such that when said overlapping flaps are folded inwardly, along any one of a pair of opposed crease lines, a suspended and supporting surface is formed extending substantially across the top of said body portion for supporting an article other than said food product beneath said top flap yet isolated from said food product contained in said box.

2. A box as claimed in claim 1, wherein the top panel is continuous with the rear panel of the body portion.

3. A box as claimed in claim 1 wherein the front panel of the body portion is provided with an end flap for securing to the side panel separate from the front panel in the assembled box.

4. A box as claimed in claim 1, wherein the end flap of the rear panel is provided with a flange along its length which, in the assembled box, is bent and tucked against the front panel of the box.

5. A box as claimed in claim 1, wherein the end flaps of the side panels for forming the base portion are dimensioned such that, in the assembled box, the flaps overlap one another.

6. A box as claimed in claim 5, wherein the end flap of the rear panel is folded inwards first, the end flaps of the side panels are folded thereover and the end flap of the front panel is folded over and secured to the end flaps of the side panels.

7. A box as claimed in claim 5, wherein at least one of the end flaps of the side panels is provided with an indented side to prevent the flap from being visible in the fully assembled box.

8. A box as claimed in claim 1 wherein the two overlapping flaps of the lid portion are continuous with respective to said side panels of the body portion, being separated therefrom by fold lines.

9. A box as claimed in claim 1, wherein said fold lines are half-cut lines.

10. A box as claimed in claim 1, wherein said crease lines are provided across approximately one third of the length of the flaps.

11. A box as claimed in claim 1 wherein the top flap comprise two sections, a first section for folding over the overlapping end flaps of the side panels and a second section for folding over the front panel and securing the lid to the body portion by means of an adhesive.

12. A box as claimed in claim 11, wherein the second section is provided with the tear-away strip for detaching the lid portion from the body portion to enable opening of the box.

13. A box as claimed in claim 1, wherein the top flap comprises two sections, one section being continuous with the rear panel of the body portion and the second section being continuous with the front panel of the body portion, both being separated from their respective panels by fold lines.

14. A box as claimed in claim 13, wherein the sections are at least half the width of their respective panels.

15. A box as claimed in claim 13, wherein each section is provided with a line of complimentary spaced apart cut lines to form respectively male and female portions of a tear-away strip whereby, in the assembled box, the sections are folded over the overlapping end flaps of the side panels and secured to each other by means of an adhesive.

16. A box as claimed in claim 15, wherein a line of adhesive is provided between the outermost edge of one of the sections and the cut line thereof for securement to the corresponding part of the underlying section.

* * * * *

UNITED STATES PATENT AND TRADEMARK OFFICE

CERTIFICATE OF CORRECTION

PATENT NO. : 6,209,785 B1
DATED : April 3, 2001
INVENTOR(S) : Amit Ben-Haim

It is certified that error appears in the above-identified patent and that said Letters Patent is hereby corrected as shown below:

Column 6, claim 1, through Column 7, line 1,
The language "said two overlapping flaps and said plurality of parallel and space crease lines" should be omitted.

Signed and Sealed this

Twenty-fifth Day of December, 2001

*Attest:*

*Attesting Officer*

JAMES E. ROGAN
*Director of the United States Patent and Trademark Office*